United States Patent [19]

Parsons

[11] 4,126,980

[45] Nov. 28, 1978

[54] METAL GRATING

[75] Inventor: Jack Parsons, Malton, England

[73] Assignee: Norton Engineering Alloys Company Limited, Malton, England

[21] Appl. No.: 807,599

[22] Filed: Jun. 17, 1977

[30] Foreign Application Priority Data

Jun. 19, 1976 [GB] United Kingdom ..... 25525/76

[51] Int. Cl.[2] ..... E04B 2/42

[52] U.S. Cl. ..... 52/669

[58] Field of Search ..... 52/660–669

[56] References Cited

U.S. PATENT DOCUMENTS

| | | | |
|---|---|---|---|
| 1,620,846 | 3/1927 | Wells | 52/667 X |
| 1,734,660 | 11/1929 | Williams et al. | 52/667 X |
| 1,917,573 | 7/1933 | Black | 52/667 X |
| 3,455,005 | 7/1969 | Mentis | 52/667 X |
| 3,716,027 | 2/1973 | Vickstrom et al. | 52/669 |
| 3,948,013 | 4/1976 | Lobaugh et al. | 52/669 |
| 3,956,788 | 5/1976 | Nagin | 52/664 |
| 4,037,383 | 7/1977 | Diebold et al. | 52/664 |

*Primary Examiner*—J. Karl Bell

*Attorney, Agent, or Firm*—Lowe, King, Price & Becker

[57] ABSTRACT

A metal floor grating comprises a number of parallel load carrying bars interconnected by a number of crossbars, the load carrying bars having an upper (in use) flange or flanges and the bars having a number of plain holes through which the crossbars extend, the crossbars being mechanically deformed betwen the load carrying bars to provide sections having at least one dimension greater than the corresponding dimension of the plain holes, and sections lying within the holes of greater length than the thickness of the load carrying members.

8 Claims, 9 Drawing Figures

METAL GRATING

This invention relates to metal grating, and particularly to metal grating adapted for use in or as a floor.

Metal floor gratings are known, and are known to be formed from a number of spaced parallel load carrying bars held together in a rigid manner by crossbars lying at 90° to the load carrying bars. Frequently, such metal floor gratings are employed in an industrial environment and subjected to vibration causing unpleasant noise when loose joints and hence inadequate interlocking engagement are to be found between the load carrying bars and the crossbars. In British Specification 969,109 there is proposed a form and method of construction of metal floor grating which overcomes this problem and which avoids the need to use heavy and bulky materials whilst at the same time providing a high load bearing capability. Thus, in British Specification 969,109, a number of parallel load carrying bars are provided with aligned, notched holes through which crossbars pass, the crossbars being mechanically deformed between the load carrying bars such that the metal of the crossbars fills the respective holes and the notches to lock in positive manner the load carrying bars to the crossbars. However, to ensure that metal from the crossbars fills the notches, mechanical deformation of the crossbars must take place immediately adjacent the side faces of the load carrying bars, and accordingly, unless deformation tools of great complexity are provided, only flat sided load carrying bars can be utilised. Unless, therefore, a large number of load carrying bars are used, and a far greater number than the load bearing characteristics requires, there is inevitably provided a gap between adjacent load carrying bars of considerable width in comparison with the width of the bars themselves. Whilst such gratings are efficient and effective in serving their intended purpose, they have the disadvantage that the heels of, e.g. ladies shoes can pass between adjacent load carrying bars, and the upper edges (in use) of the load carrying bars present sharp edges, frequently deliberately serrated to increase the frictional grip of the bars on footwear, can constitute a hazard should a user fall onto the grating.

According to the present invention, a metal floor grating comprises a number of parallel load carrying bars interconnected by a number of crossbars, the load carrying bars having an upper (in use) flange or flanges and the bars having a number of plain holes through which the crossbars extend, the crossbars being mechanically deformed between the load carrying bars to provide sections having at least one dimension greater than the corresponding dimension of the plain holes, and sections lying within the holes of greater length than the thickness of the load carrying members.

Thus, with a number of load carrying members placed in side-by-side relationship, with corresponding holes in adjacent members in alignment, crossbars of the same cross-sectional shape are passed through corresponding holes, the crossbeams being slightly smaller than the holes to allow their easy passage. The crossbeams are then mechanically deformed between the members to provide one dimension greater than the corresponding dimension of the holes, over a length less than the distance between adjacent faces of the members, i.e. spaced from the side faces of the load carrying members. However, the nature of the mechanical deformation is such that there is a longitudinal flow of metal in the crossbeam which causes the parts of the crossbeams lying within the holes to expand in the same direction whereby the crossbeams are forced into intimate contact with the holes at diametrically opposite points, the crossbeams exhibiting a sharp increase in cross-sectional size to each side of the holes in the plane of the said greater dimension. Accordingly, the load carrying members are positively locked to the crossbeams.

By avoiding the need for notches associated with the holes, and hence the need for deformation immediately adjacent the side faces of the load carrying members, the (in use) lower end of the load carrying members can be of increased thickness, e.g. by being provided with flanges, to provide better load distribution on the supporting surface below the grating. Preferably the flange or flanges at the upper end are provided by forming the load carrying members of T- or L-shape. By providing an upper flange or flanges, the crossbars passing through the outermost load carrying members need only be severed such that the protruding ends lie within the width cf the flange, leaving sufficient of the deformed portion of the crossbars to positively lock the outermost member to the crossbars. If however, the location of the grating requires the crossbar to be severed flush with the outer face of the vertical part of the load carrying members, depressions may be provided in the outer face of each outermost member, into which metal from the crossbeam is forced either during deformation of the crossbeam or during the severing of the excess of crossbeam extending beyond the outermost members, to positively lock the outermost members to the crossbeams.

To provide adequate friction between the upper flanges of the load carrying member, and e.g. the footwear of users, the upper face of the flange or flanges may be provided with longitudinal grooves, and which can readily be formed when the load carrying members are formed by an extrusion process. However, in use, the load carrying members are intended to extend transversely of the intended direction of movement of users, and it is therefore preferred to provide additional means to provide slip resistance transversely of the grating when in use. Thus, additional members of rectangular cross-section on the crossbars may be provided in the gaps between T- or inverted L-section load carrying members, which additional members have a serrated upper edge. By providing such additional members between T- or inverted L-section load carrying members, locked to the crossbars in like manner, the additional members are less harzardous in use than when such additional members are used alone. The semi-continuous surface provided by the upper flanges of the load carrying members can provide adequate support for anyone falling onto the grating, and again the reduced gap between adjacent members prevents the heel of shoes from passing down between them.

It is equally possible to provide a completely closed upper (in use) surface, either by providing the T- or inverted L-shaped support members with a flange width and a spacing on the crossbars such that adjacent flanges abut each other, or a briding piece may be used to fill the gaps between adjacent flanges to provide a gap free (upper) surface.

According to a still further feature, a method of producing metal grating of the type defined, comprises placing a plurality of flanged load carrying members flange downwards on a support surface, with the flange(s) lying in recesses in the support surface to ensure that the load carrying members are in correct spaced parallel relationship, passing crossbars through correspondingly shaped holes in successive load carrying members, positioning comb-like swaging tools above the load carrying members such that parts of the tools extend between the members to lie to each side of a crossbeam over part of the length of the crossbeam between adjacent members, and closing the swaging tools onto those lengths of the crossbeams to deform them and provide them with a dimension greater than the corresponding dimension of the corresponding holes, with consequent flow of metal longitudinally of the crossbeam to increase the corresponding dimension of the crossbeams within the holes into intimate contact with the holes.

Several embodiments of the invention will now be described with reference to the accompanying drawings in which.

Figure 1:
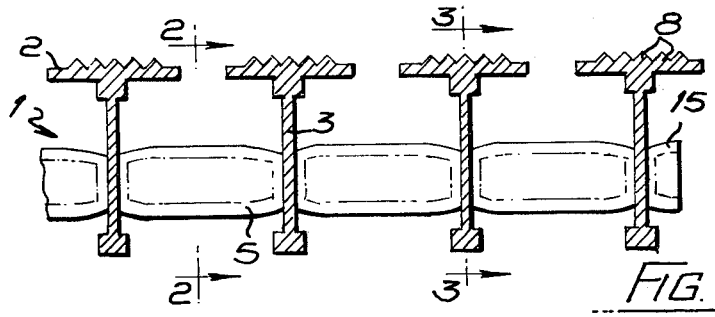
FIG. 1 is a sectional side elevation of metal grating according to the invention.
Figure 7:
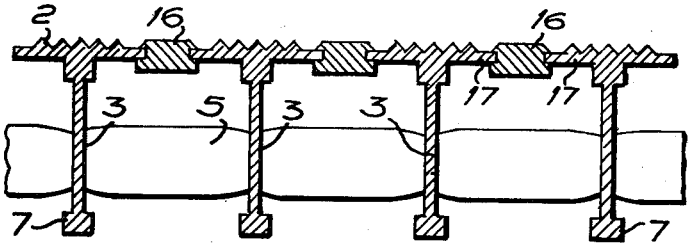
Figure 8:
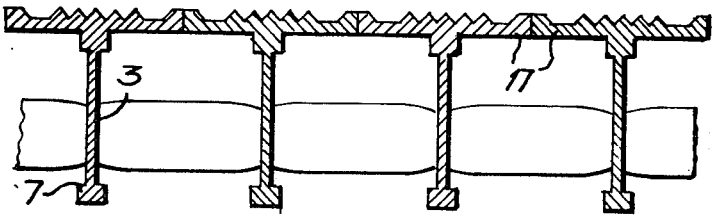
Figure 9:
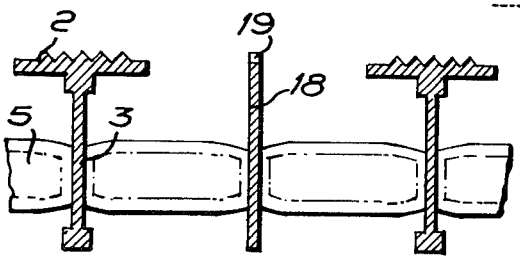

FIG. 7 corresponds to FIG. 1, but shows an alternative construction of grating according to the invention;

FIG. 8 corresponds to FIG. 1, but shows a further alternative construction of grating according to the invention; and FIG. 9 corresponds to FIG. 1 but shows yet another alternative construction of grating according to the invention.

Figure 2:
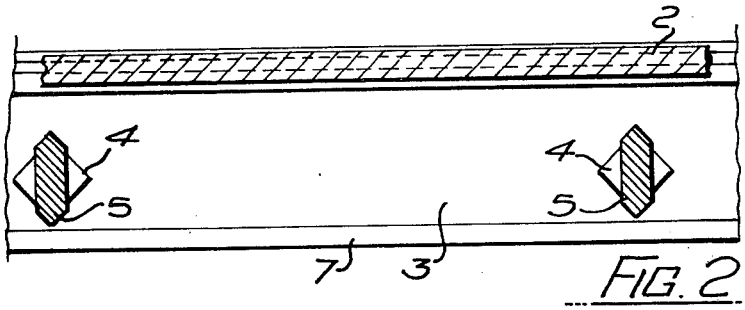
FIG. 2 is a section on the line 2—2 of FIG. 1.
Figure 3:
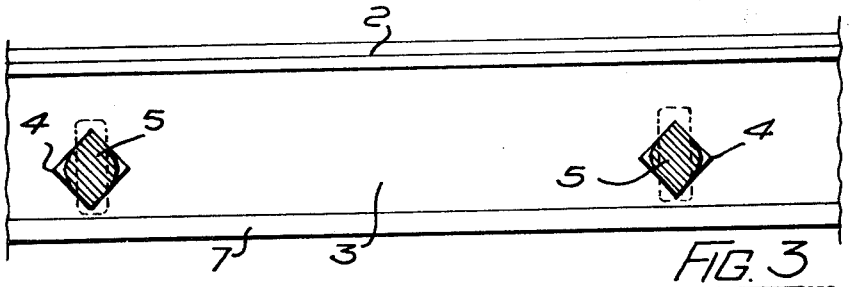
FIG. 3 is a section on the line 3—3 of FIG. 1.
Figure 4:
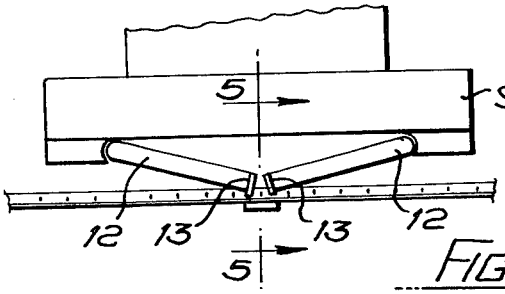
FIG. 4 is a schematic side elevation of swaging tools for producing the grating of FIG. 1.
Figure 5:
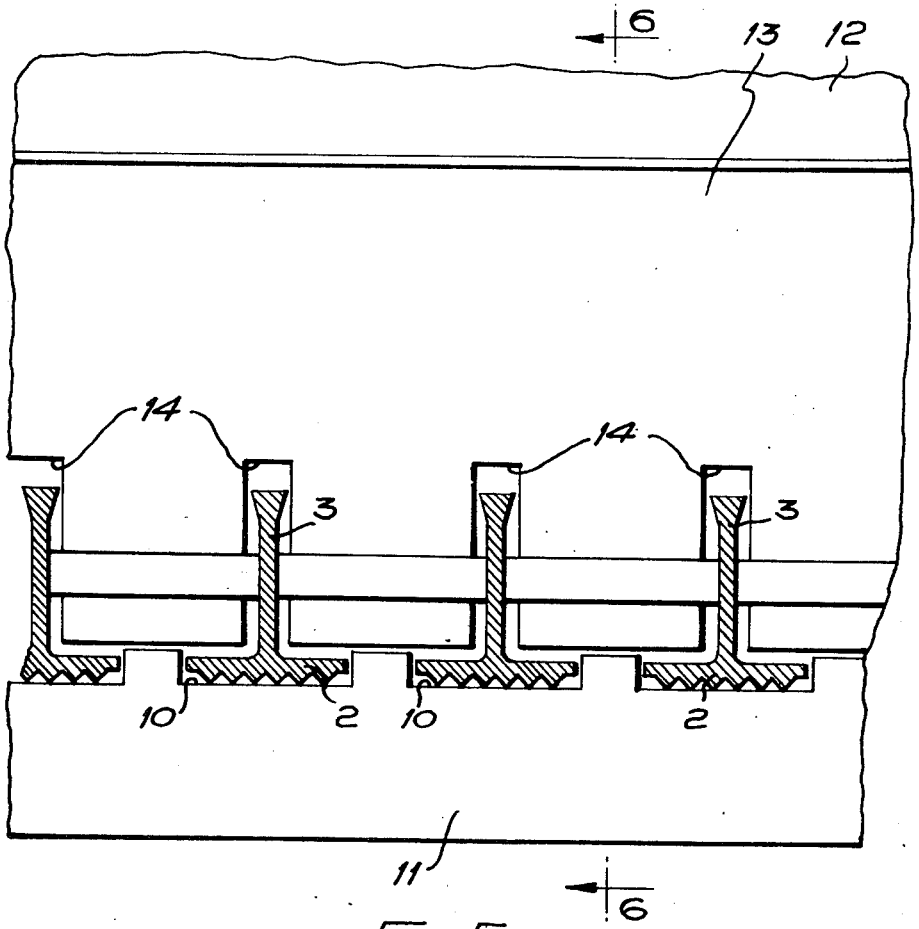
FIG. 5 is a section on the line 5—5 of FIG. 4.
Figure 6:
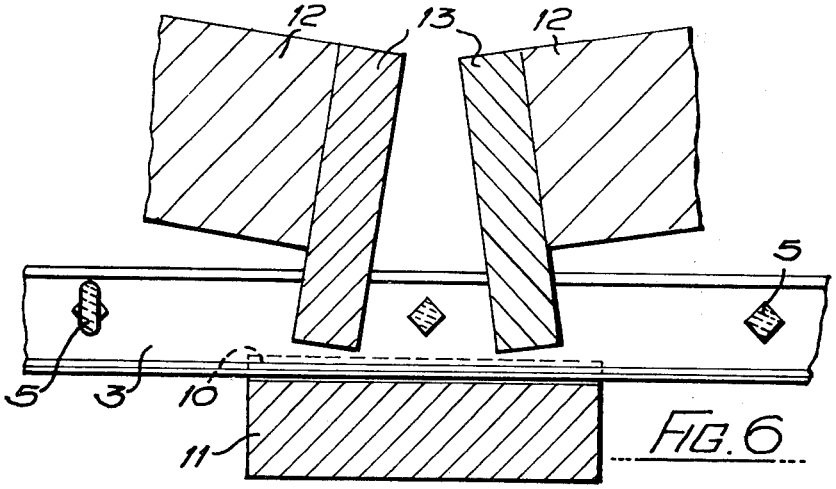
FIG. 6 is a section on the line 6—6 of FIG. 5.

In FIG. 1, metal grating 1 is formed by a number of load carrying members 2 of T-section. Each upright 3 of each T-section member 2 has a series of equally spaced diamond-section holes 4 through which extend crossbeams 5. Each crossbeam 5 is swaged between adjacent uprights 3 such that the vertical height of the crossbeam between the uprights is greater than the maximum vertical dimension of the holes 4 (FIG. 2) and the material of the crossbeam is in intimate contact with the top and bottom of the holes (FIG. 3) as will be explained later in relation to FIGS. 4 to 6.

At the base of each upright 3 is an enlarged section 7 to assist in load distribution over a floor on which the grating is laid, and the upper surfaces of the T-section members are serrated at 8 to increase frictional resistance (slip resistance) when the grating is in use.

To produce the grating 1 (FIGS. 4 to 6) a number of T-section members 2 are placed in an inverted condition in suitable support means (not shown) such that they are parallel and equally spaced and with the holes 4 aligned. Crossbeams 5 of a cross-section corresponding to the shape of the holes and of dimensions slightly less than the holes are then passed along the holes. The assembly of load support members and crossbeams are then placed below a swaging device 9, with the load carrying members lying in the recess 10 of a comb-like support 11. On the swaging device are two pivoted swaging arms 12 carrying comb-like swaging tools 13, having recesses 14 to receive the uprights 3 of the load carrying members 2. Thus, starting a first crossbeam, and with the support 11 in position, the swaging device is lowered until the comb-like swaging tools 13 lie to either side of the crossbeam between each adjacent pair of load carrying members 2, and when continued lowering of the swaging device causes the arms 12 to pivot upwardly to close the swaging tools 13 onto the crossbeam. This results in deformation of the crossbeam to deform it between the load carrying members and provide a dimension greater than the corresponding dimension of the holes 4. At the same time, there is a longitudinal flow of metal in the crossbeam which causes the parts of the crossbeam within the holes 4 to expand in the same direction of deformation and force the crossbeam into intimate contact with the upper and lower parts of the holes 4. As is shown by FIG. 1, the crossbeam exhibits an immediate sharp increase in cross-sectional side to each side of each hole 4 and accordingly, the load carrying members are positively locked to the crossbeam. The swaging device 9 is then raised first to release the swaging tools from the crossbeam and then lift the swaging tools clear of the crossbeam, when the assembly of load carrying members is relocated to bring the second crossbeam below the swaging device and when the swaging step is repeated. When the last crossbeam has been swaged, the crossbeam projecting beyond the last load carrying member 2 (FIG. 1) can be cropped such that the projecting portion 15 has a smaller length than the upper surface of the T-section load carrying member but has a sufficient length to leave that member positively located.

By providing a T-section load carrying member (and here it will be understood that any other form of flanged member such as an inverted L-section could equally well be used) the collective surface area of the load carrying members is great in comparison with collective area of gaps between them, and which constitutes a significant improvement over prior constructions. However, if a completely closed surface is required, bridging members 16 can be secured between the flanges 17 of the load carrying members 2 (FIG. 7) the flanges fitting appropriate recesses in the bridging members, or the flanges so dimensioned and the members 2 so spaced on the crossbeams 5 that the flanges 17 on adjacent members are in very closely spaced or abutting relationship.

Because it is intended that the assembly of load carrying members and crossbeams are produced to predetermined lateral and longitudinal dimensions, for ease of storage and transportation, they are laid for use as abutting panels. It is further intended that the load carrying members 2 lie transversely of the intended direction of movement of users, and when the serrations 8 provide traction and slip resistance in the intended direction of use. If required, slip resistance can be created in the transverse direction by providing between the load carrying members 2 further rectangular section members 18 can be provided (FIG. 8) located on the crossbeams in the same manner as the members 2, and the upper edges (in use) provided with serrations 19. However, because the additional members 18 lie in the gaps between the flanges 17 of the members 2, they are considerably less hazardous than when such members are used alone as in prior constructions.

What I claim is:

1. A metal floor grating comprising a number of parallel load carrying bars interconnected by a number of crossbars, the load carrying bars each having at least one upright member and at least one upper flange, a number of holes in said upright member through which the crossbars extend, the crossbars being mechanically deformed between the load carrying bars to provide first sections located between the upright sections of adjacent load carrying bars and having at least one dimension greater than the corresponding dimension of the holes, and second sections extending through the holes and being of greater length than the thickness of the upright members of the load carrying bars, said second sections being expanded into intimate contact with the upright members within the holes and being increased in cross-sectional size adjacent each side of the holes to positively lock the load carrying bars to the crossbars.

2. A metal floor grating as in claim 1, wherein the upper flange is formed integrally with the upright member of the load carrying bars.

3. A metal floor grating as in claim 1, wherein the upper face of the flange of each load carrying bar is formed with longitudinal grooves.

4. A metal floor grating as in claim 1, wherein additional rectangular cross-section members are mounted on the crossbars in the gaps between said flanges, which additional members have a serrated upper edge.

5. A metal floor grating as in claim 1, wherein the adjacent flanges on the load carrying bars are so dimensioned, and the load carrying bars so located on the crossbars that a gap-free upper surface is provided.

6. A metal floor grating as in claim 1, wherein a bridging member is secured between the adjacent flanges on adjacent load carrying bars to provide a gap-free upper surface.

7. A metal floor grating as in claim 1, wherein said holes are diamond-shaped.

8. A metal floor grating as in claim 7, wherein said crossbars are swaged between adjacent upright members to provide a vertical dimension greater than the corresponding vertical dimension of the holes.

* * * * *